United States Patent [19]

Ullman, Jr.

[11] 4,354,370

[45] Oct. 19, 1982

[54] METHOD FOR DEEP DRAWING SHEET METAL

[75] Inventor: Myron E. Ullman, Jr., Canfield, Ohio

[73] Assignee: Kessler Products Co., Inc., Youngstown, Ohio

[21] Appl. No.: 183,308

[22] Filed: Sep. 2, 1980

[51] Int. Cl.[3] ..... B21D 22/20

[52] U.S. Cl. ..... 72/42

[58] Field of Search ..... 29/423, 424; 72/41, 72/42, 46, 47

[56] References Cited

U.S. PATENT DOCUMENTS

| | | | |
|---|---|---|---|
| 1,384,448 | 4/1921 | Gilbert et al. | 72/278 |
| 2,116,954 | 5/1938 | Singer | 148/4 |
| 2,602,538 | 7/1952 | Bimba et al. | 205/2 |
| 2,706,850 | 4/1955 | Sejournet et al. | 29/423 |
| 2,743,811 | 3/1956 | Delcroix | 207/2 |
| 3,127,015 | 3/1964 | Schieren | 72/42 |
| 3,191,286 | 6/1965 | Armstrong et al. | 29/424 |
| 3,191,413 | 6/1965 | Stulen | 72/41 |
| 3,192,619 | 6/1965 | Rausch et al. | 29/424 |
| 3,250,103 | 5/1966 | Beaublen et al. | 72/42 |
| 3,254,401 | 6/1966 | Dalton et al. | 29/423 |
| 3,255,621 | 6/1966 | Ohsol | 72/42 |
| 3,258,319 | 6/1966 | Cox, Jr. | 29/195 |
| 3,433,038 | 3/1969 | Stump | 72/42 |
| 3,568,486 | 3/1971 | Rosenberg et al. | 72/42 |
| 3,580,019 | 5/1971 | Beresnev et al. | 72/47 |
| 3,776,848 | 12/1973 | Hall et al. | 252/49.5 |
| 3,873,458 | 3/1975 | Parkinson | 252/49.5 |
| 3,890,818 | 6/1975 | Charsonville | 72/42 |
| 3,978,702 | 9/1976 | Barker et al. | 72/42 |
| 3,983,044 | 9/1976 | Felton, Jr. | 252/33 |
| 3,992,303 | 11/1976 | Barker et al. | 252/37 |
| 4,091,123 | 5/1978 | Ayusawa et al. | 72/42 X |

FOREIGN PATENT DOCUMENTS

| | | | |
|---|---|---|---|
| 1111132 | 7/1961 | Fed. Rep. of Germany | 72/42 |
| 868126 | 5/1961 | United Kingdom | 72/42 |

OTHER PUBLICATIONS

Blake, D., "Polymer Lubrication for the Cold Extrusion of Mild Steel," Metallurgia and Metal Forming, Jan. 1972, p. 30.

Rao, U. S., "Polythene as a Lubricant for Deep Drawing," Sheet Metal Industries, Oct. 1967, p. 673.

Mear, D. R., "The Use of Organic Polymers as Lubricants in Deep-Drawing," Sheet Metal Industries, Jul. 1963, p. 477.

*Primary Examiner*—Ervin M. Combs

*Attorney, Agent, or Firm*—David A. Burge Co.

[57] ABSTRACT

An improved method of lubrication in a deep drawing process utilizes a plurality of distinct plastic sheets, loosely overlying one another, laid across at least one major surface of a flat blank to be drawn. In preferred practice, a pair of such distinct plastic sheets are laid across each of the opposed major surfaces of a flat blank in preparation for a drawing operation. The plastic sheets are maintained in position while interfitting drawing tools, namely a punch and a die, close together to effect drawing of the blank. The plastic sheets serve as a lubricant during the drawing process. Selected surfaces of the sheets or the material from which the sheets are formed may be provided with an additional conventional lubricating substance to enhance lubricity of the sheets, or conventional lubricant may be utilized between the sheets of each pair.

19 Claims, No Drawings

METHOD FOR DEEP DRAWING SHEET METAL

BACKGROUND OF THE INVENTION

1. Field of the Invention

The present invention relates generally to a metal drawing process and, more particularly, to an improved lubrication system which is particularly well-adapted for one step deep drawing of metal articles such as steel sinks, tubs, automobile fenders and the like.

2. Prior Art

A drawing process is one wherein a relatively flat metal piece is deformed by compression between a pair of interfitting drawing tools, namely a punch and a die. The drawing process is performed on a press which positions the interfitting drawing tools at opposite ends of a path of travel, which moves the tools relative toward each other along the travel path to effect drawing of a flat blank placed along the travel path, and which moves the tools relatively apart to permit removal of the drawn part. As the tools close against the blank during drawing, the blank is deformed to a desired shape as complex stresses are imparted in the blank.

A problem of current times is that good drawing quality enameling steel is not readily available. In previous years, this product was made far more widely than it is now. Moreover, in previous years, competition tended to produce drawing quality enameling steel of greater uniformity and of better quality than is now available. As a result of these current day changes, the problem of providing effective lubrication systems for use in deep drawing operations is rendered far more difficult than it was only a few years ago.

In the manufacture of such deep drawn structures as deep bowl kitchen sinks, few manufacturers are able to draw a deep sink bowl from a single piece of steel because the required extensive deformation induces large, complex stresses which are not easily controlled or minimized. Stress reduction in such an operation has previously been attempted by the use of lubricants known as drawing compounds.

It is known to apply lubricants to the faces of the drawing tools to enable the metal blank to "flow" more readily during the drawing process, thereby reducing the stresses imparted in the blank. The lubricants used for such purposes are known as drawing compounds. These compounds must adhere to both the metal blank and to the drawing tools so that the compounds will continuously provide an uninterrupted lubricating film as the drawing process proceeds. Moreover, the compounds need to be washable so they can be easily but thoroughly removed from the surfaces of the newly formed sink or other deeply drawn part to enable the part to be properly enameled or otherwise finished.

Many conventional lubricants have been developed which are based on oils, greases, fats, soaps, and related products. Specially modified formulations are utilized in attempts to satisfy the requirements of a particular type of deep drawing operation. A drawing compound found to be reasonably suitable for a particular drawing operation is often found to be entirely unsuitable for use in a very similar type of drawing operation. Consequently, locating, testing and deciding upon the type of drawing compound to be used with a particular drawing operation can amount to a difficult and expensive task.

Very few of the commercially available drawing compound products have met the needs of deep sink bowl manufacturers. The products that have been found to be of reasonable utility are very expensive and they are not widely available. In at least one case the most effective product was proprietary in nature, protected by trade secret. When the manufacturer stopped its manufacture, the product was no longer available at any price.

The few conventional lubricants which have been found to be reasonably effective for use in the deep drawing of steel sinks have had other drawbacks. The operation of applying these compounds to blanks about to be drawn is time consuming, messy and wasteful. Moreover, the lubricants are not thoroughly removable from newly formed sinks by commerical washing techniques. Consequently, the lubricants tend to remain in the pores of the metal sink and to make satisfactory finishing such as enameling of the sinks difficult if not impossible. Still further, even with relatively effective conventional lubricants, sink manufacturers have experienced unacceptably high rates of rejection due to insufficient lubricating characteristics of the lubricant during drawing.

Recent proposals to overcome some of the foregoing drawbacks have suggested the use of dry plastic polymer films adhered to one or both sides of a metal blank which is to be drawn. Such proposals are inherently expensive, require special equipment to apply the dry film-forming resins, consume large amounts of space to carry out, and require unduly long handling times during drying of the applied resins. Moreover, special procedures must be instituted to effect removal of the resins following drawing operations and prior to subsequent surface treatment. Here again, extra equipment and handling are required.

Still another proposal has been to employ a single discrete sheet of commercially available polymer film placed against either side of a blank to be drawn. The use of non-adhered polymeric films is acknowledged to provide a lubricating function in drawing operations.

In spite of the above-described advances, there remains a need for an improved lubrication system for use in the drawing of sheet metal products. There is a need for a lubrication system which can be used uniformly with a wide variety of drawing situations, i.e., which does not require the selection or development of special formulations for each particular job. There is a need for a simple lubrication system which does not rely on proprietary, generally unavailable compositions; which is cost effective; which eliminates coating and removal steps and their attendant labor, equipment, and time expenditures; which eliminates waste and which provides the lowest possible rate of product rejections.

SUMMARY OF THE INVENTION

The present invention overcomes the foregoing and other drawbacks of prior proposals by providing a novel and improved, yet inexpensive and readily implementable lubrication system for deep drawing processes. The method is particularly well adapted for use in drawing deep bowl sinks, tubs, car fenders and the like which are subsequently enameled.

In accordance with the more basic features of the present invention, a drawing process is rendered more effective and less expensive by an improved system for lubricating a blank during a drawing operation. A feature of the system of the present invention is that it can be used successfully with a wide variety of deep drawing situations, and does not require the selection or formulation of lubricating substances suitable to each different environment.

In practicing the present invention, at least a pair of plastic sheets are grouped in loosely overlying fashion and are positioned across one major face of a blank so as to lubricate such major face when engaged by a drawing tool during drawing of the blank. Controlled positioning of the sheets prevents direct contact between such major blank face and the tool, and provides highly effective, efficient lubrication.

In preferred practice a drawing process is improved by a lubrication method utilizing two pairs of distinct plastic sheets. The first pair of sheets, loosely overlying one another, overlie one major face of a blank on the punch side of the blank. The second pair of sheets, loosely overlying one another, overlie the blank's opposite face, on the die side of the blank. Each pair of sheets is maintained between the blank and the adjacent drawing tool to prevent direct contact of the blank by such tools during a drawing operation.

In a further aspect of this invention at least a pair of loosely overlying plastic sheets may be provided on one selected side of the blank, while only a single sheet is provided on the opposite side of the blank.

In another aspect of this invention, a plurality of loosely overlying plastic sheets are provided on each of two opposite sides of the blank.

Still other features of the invention lie in the use of conventional lubricants between the sheets of each pair, or the use of powder lubricants either between the sheets of each pair or incorporated into the material from which such sheets are formed.

As will be apparent from the foregoing summary, it is a general object of the present invention to provide a novel and improved method of lubrication during a deep drawing process.

It is a further object to provide such an improved lubrication method which will facilitate the drawing of such parts as deep bowl sinks, tubs, automobile fenders and the like, effectively and efficiently, while minimizing the rate of rejection.

These and other objects and a fuller understanding of the invention may be had by referring to the following detailed description and claims.

DESCRIPTION OF THE PREFERRED EMBODIMENT

A drawing process embodying the preferred practice of the present invention utilizes a conventional industrial press which has interfitting, matable punch and die tools. When these drawing tools are moved into interfitting relationship, the narrow spaces between their mating surfaces define the shape of the article, e.g., a deep bowl sink, which is to be produced. The punch and die tools are positioned at opposite ends of a travel path along which at least one of these tools is movable relative to the other during the drawing process.

Prior to the start of the actual drawing operation a metal blank from which a drawn part will be made is sandwiched between two pairs of sheets of plastics material with the blank lying along the travel path of the drawing tools. Each of the pairs of sheets has first and second distinct plastic sheets which are grouped or assembled to loosely overlie one another. These sheets may be partially peripherally connected or they may be completely unconnected.

While the sequence in which the plastic sheet pairs and the metal blank are positioned in the travel path is merely a matter of choice as determined by convenience, the preferred practice is as follows. A first of the two pairs of plastic sheets is positioned transverse to the travel path on the die. The metal blank is then positioned atop this first pair of sheets overlying the die. The second pair of plastic sheets is then positioned transverse to the travel path at a location atop the blank, intermediate the punch and blank.

The plastic sheet pairs are arranged parallel to and generally aligned with the opposed major surfaces of the blank. The plastic sheet pairs thus effectively sandwich the blank and prevent direct contact between the blank and the adjacent drawing tools. During the actual drawing operation the interaction of the mating punch and die causes the outermost surfaces of the plastic sheet pairs to come into direct contact with the drawing tools, and causes the innermost surfaces of the plastic sheet pairs to come into direct contact with opposed major surfaces of the blank. The plastic sheet pairs form a protective barrier which prevents the drawing tools from directly contacting the adjacent blank surfaces during drawing, the sheets of each pair tend to slide over each other, and this relatively low friction sliding undoubtedly does much to enhance lubrication.

The plastic sheets utilized in this invention are standard products which are commercially available. Particular products which have been successfully employed are sheets of polyethylene, polyvinylchloride and mylar, with each sheet having a thickness within the range of about 1.5 to 2.0 mils. Any plastics sheet film which has relatively high lubricity and sufficient thickness to prevent tearing can be used. The least expensive but still workable product is preferred.

The mechanism by which a pair of loosely overlying plastic sheets provides lubrication is not fully understood. However, it is clear that a pair of sheets is unexpectedly more effective in providing a lubrication vehicle (i.e., reducing friction and heat generation) than is a single sheet. Moreover, the use of a pair of sheets is far more effective than is the use of such conventional lubricants as have previously been employed. The use of plastic sheet pairs meets or exceeds all the capabilities of conventional lubricants previously used to form deep bowl sinks.

The use of plastic sheet pairs serves to effectively lubricate the metal blank during drawing to facilitate its sliding into the die cavity. Using the improved lubrication method embodied in this invention, a very low rejection rate (as low as 2 percent) has been found to be maintainable. This contrasts with a higher rejection rate (typically 10–12 percent) obtained when using only a single film layer is used as a lubricant, and a still higher rejection rate (typically 8—20 percent) commonly encountered when using one of the conventional lubricants.

The plastic sheet pairs are found to "adhere" to both the metal blank and the drawing tools in the sense that they are not prone to being punctured or scrapped away or torn during the drawing process. The plastic films stretch during drawing as is needed to provide an uninterrupted pair of shielding and lubricating films. The sheets tend to separate automatically from the drawn part when the drawing process has been completed, this being due to the "memory" the films have of their original flat shape, and their tendency to return to the memory state.

Following drawing process, the plastic sheet pairs may be readily removed from the newly drawn article with a mere pull on the sheets. This is quite unlike the problems encountered with conventional lubricants which must be scrubbed away. The easy manner in which the sheets may be removed from the drawn part results in a considerable savings of operating expense.

The use of plastic sheet pairs is advantageous in still another regard. Besides providing a more effective lubricating system, the sheets are much cheaper than the conventional lubricants previously employed. Conventional lubricants required copious quantities of material costing several dollars per pound, which were not always readily available, and which needed to be carefully applied. Plastic sheets may be provided at a fraction of the cost of conventional lubricants, are readily available, and require no extensive application efforts.

Variations of the invention of the preferred embodiment are also within the scope of this invention. For example, the plastic sheet assembly on one side of the blank need not be limited to a pair but may constitute any suitable plurality of sheets, e.g. 3 or 4. Also a plurality of sheets may be used on one side of a blank while only a single sheet is used on the opposite side. Moreover, a plurality of sheets may be used on one side while no sheets at all are employed on the other side of the blank.

Still another possible variation relates to the use of a plurality of sheets in combination with conventional lubricants. A plurality of sheets can, for example, be used on one side of a blank (preferably the side to later be enameled) and a conventional lubricant on the other. Alternatively, a conventional lubricant may be used in contact with one or both of a pair of sheets. Still another possibility is to utilize a lubricant between the sheets of each pair, for example a powder lubricant such as talc or graphite.

While the improved lubrication system disclosed herein is highly effective in the production of deep bowl kitchen sinks, tubs, car fenders and the like, it is not limited to these applications.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of drawing an article from a generally flat metal blank, comprising:

(a) providing a press including mating drawing tools such as a punch and a die, these tools normally being positioned at opposite ends of a travel path along which at least one of the tools is movable relative to the other during a drawing process;

(b) positioning pairs of plastic sheets and a relatively flat metal blank having first and second opposed surfaces transverse to the travel path with:

(i) each of the opposed surfaces of the blank facing toward a separate one of the tools;

(ii) the plastic sheets including first and second pairs of distinct plastic sheets;

(iii) the first pair of sheets loosely overlying each other and being positioned in overlying relationship with the first surface at a location between the first surface and one of the tools; and (iv) the second pair of sheets loosely overlying each other and being positioned in overlying relationship with the second surface at a location between the second surface and the other of the tools; and (c) moving at least one of the tools along the travel path relatively toward the other tool to effect drawing of the blank while maintaining the sheet pairs at locations between the tools and the blank to serve as lubricants during the drawing of the blank with the sheets of each pair being free to slide relative to each other to enhance lubrication.

2. The method of claim 1 additionally including the steps of moving at least one of the tools along the travel path relatively away from the other of the tools at a time after the drawing of the blank has been completed, and removing the pairs of sheets from the travel path and from positions of engagement with the tools and the drawn blank, such removal being effected by exerting pulling forces on the sheets without causing any of the sheets to be severed into separate parts.

3. The method of claim 1 additionally including the step of providing a conventional lubricant between the sheets of each pair prior to the initiation of drawing of the blank.

4. The method of claim 3 wherein the lubricant is in powder form.

5. In a drawing process wherein a generally flat blank is initially positioned intermediate such relatively movable, mating drawing tools as a punch and a die, and wherein the drawing tools are moved relatively toward each other to effect drawing of the blank, an improved method for lubricating the blank during the drawing process, comprising the steps of:

(a) providing a first pair of distinct plastic sheets loosely overlying one another and overlying one major face of the blank at a location intermediate the blank and one of the drawing tools;

(b) providing a second pair of distinct plastic sheets loosely overlying one another and overlying the opposite major face of the blank at a location intermediate the blank and the other of the drawing tools; and, (c) maintaining the sheet pairs between the blank and the drawing tools during drawing of the blank to prevent direct contact between the blank and the drawing tools with the sheets of each pair being free to slide relative to each other to enhance lubrication.

6. The method of claim 5 additionally including the steps of moving at least one of the tools along the travel path relatively away from the other of the tools at a time after the drawing of the blank has been completed, and removing the pairs of sheets from the travel path and from positions of engagement with the tools and the drawn blank, such removal being effected by exerting pulling forces on the sheets without causing any of the sheets to be severed into separate parts.

7. The method of claim 5 additionally including the step of providing a conventional lubricant between the sheets of each pair prior to the initiating of drawing of the blank.

8. The method of claim 7 wherein the lubricant is in powder form.

9. In a drawing process wherein a generally flat blank is initially positioned at a work station intermediate such matable drawing tools as a punch and a die, and the drawing tools are moved relatively toward each other to effect drawing of the blank, an improved method for lubricating the blank during drawing, comprising the steps of:

(a) providing a first plurality of plastic sheets loosely overlying each other and laid across one major face of the blank;

(b) providing a second plurality of plastic sheets loosely overlying each other and laid across the opposed major face of the blank;

(c) maintaining each plurality of sheets between its associated blank face and the adjacent drawing tool during the drawing process whereby direct contact between either blank face and the adjacent tool is prevented while the sheets of each pair are free to slide relative to each other to enhance lubrication.

10. In a drawing process where a generally flat blank is initially positioned at a work station intermediate such matable drawing tools as a punch and a die, and the drawing tools are moved relatively toward each other to effect drawing of the blank, an improved method for lubricating the blank during drawing, comprising the steps of:

(a) providing at least a pair of plastic sheets loosely overlying each other and spread across one major face of the blank; and (b) maintaining the sheets between the associated blank face and the adjacent drawing tool during the drawing process to prevent direct contact between that blank face and the adjacent drawing tool while the sheets of each pair are free to slide relative to each other to enhance lubrication.

11. The process of claim 10 wherein the sheets provided are disposed on the die side of the blank.

12. The process of claim 10 wherein the sheets provided are disposed on the punch side of the blank.

13. The process of claim 10 further comprising the step of providing at least one plastic sheet spread across the opposed major face of the blank.

14. The process of claim 11 further comprising the step of providing at least one plastic sheet spread across the opposed major face of the blank.

15. The process of claim 12 further comprising the step of providing at least one plastic sheet spread across the opposed major face of the blank.

16. The process of claim 10 further comprising the step of applying a conventional lubricant which is compatable with plastic sheets between at least one of the tools and the immediately adjacent plastic sheet.

17. The process of claim 10 further comprising the step of applying a lubricant compatible with plastic sheets between at least two overlying plastic sheets.

18. The process of claim 10 further comprising the step of applying a lubricant compatible with plastic sheets between the one major face of the blank and the adjacent ones of the plastic sheets.

19. The process of claim 10 further comprising the step of forming at least one of the plastic sheets of a material incorporating a powder lubricant.

* * * * *